US006616442B2

(12) United States Patent
Venizelos et al.

(10) Patent No.: US 6,616,442 B2
(45) Date of Patent: Sep. 9, 2003

(54) LOW $NO_X$ PREMIX BURNER APPARATUS AND METHODS

(75) Inventors: Demetris Venizelos, Claremore, OK (US); R. Robert Hayes, Collinsville, OK (US); Richard T. Waibel, Broken Arrow, OK (US); Wesley R. Bussman, Tulsa, OK (US)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 09/726,937

(22) Filed: Nov. 30, 2000

(65) Prior Publication Data

US 2002/0064740 A1 May 30, 2002

(51) Int. Cl.[7] ..... F23D 14/26

(52) U.S. Cl. ..... 431/8; 431/350; 431/347; 431/159; 431/171

(58) Field of Search ..... 431/159, 171, 431/181, 174, 278, 284, 285, 8, 350, 347, 115, 116; 60/749

(56) References Cited

U.S. PATENT DOCUMENTS

| | | | | | |
|---|---|---|---|---|---|
| 2,002,660 | A | * | 5/1935 | Foos | 431/161 |
| 2,263,170 | A | * | 11/1941 | Haedrike | 431/278 |
| 2,403,431 | A | * | 7/1946 | Dobrin | 431/171 |
| 3,033,273 | A | * | 5/1962 | Zink, Jr. et al. | 431/174 |
| 4,175,920 | A | * | 11/1979 | Guerre et al. | 431/175 |
| 4,257,763 | A | | 3/1981 | Reed | 431/188 |
| 4,395,223 | A | | 7/1983 | Okigami et al. | 431/10 |
| 4,505,666 | A | * | 3/1985 | Martin et al. | 431/175 |
| 4,575,332 | A | * | 3/1986 | Oppenberg et al. | 431/9 |
| 4,945,841 | A | | 8/1990 | Nakamachi et al. | 110/341 |
| 5,098,282 | A | | 3/1992 | Schwartz et al. | 431/9 |
| 5,195,884 | A | * | 3/1993 | Schwartz et al. | 431/8 |
| 5,201,650 | A | | 4/1993 | Johnson | 431/9 |
| 5,238,395 | A | | 8/1993 | Schwartz et al. | 431/10 |
| 5,275,552 | A | * | 1/1994 | Schwartz et al. | 431/10 |
| 5,284,438 | A | * | 2/1994 | McGill et al. | 431/9 |
| 5,344,307 | A | | 9/1994 | Schwartz et al. | 431/9 |
| 5,407,345 | A | | 4/1995 | Robertson et al. | 431/115 |
| 5,441,403 | A | * | 8/1995 | Tanaka et al. | 431/175 |
| 5,458,481 | A | * | 10/1995 | Surbey et al. | 431/115 |
| 5,460,512 | A | * | 10/1995 | Lifshits et al. | 431/9 |
| 5,511,970 | A | * | 4/1996 | Irwin et al. | 431/9 |
| 5,554,021 | A | | 9/1996 | Robertson et al. | 431/9 |
| 5,603,906 | A | * | 2/1997 | Lang et al. | 422/182 |
| 5,605,452 | A | | 2/1997 | Robertson et al. | 431/8 |
| 5,634,785 | A | * | 6/1997 | Bury et al. | 431/9 |
| 5,667,376 | A | | 9/1997 | Robertson et al. | 431/115 |
| 5,730,591 | A | | 3/1998 | Robertson et al. | 432/106 |
| 5,860,803 | A | * | 1/1999 | Schindler et al. | 431/9 |
| 5,980,243 | A | * | 11/1999 | Surbey et al. | 431/347 |
| 6,007,325 | A | * | 12/1999 | Loftus et al. | 431/8 |
| 6,027,330 | A | * | 2/2000 | Lifshits | 431/8 |
| 6,062,848 | A | * | 5/2000 | Lifshits | 431/285 |
| 6,347,935 | B1 | * | 2/2002 | Schindler et al. | 431/5 |
| 6,422,858 | B1 | * | 7/2002 | Chung et al. | 431/8 |

FOREIGN PATENT DOCUMENTS

| | | | |
|---|---|---|---|
| DE | 813983 | * | 7/1949 |

* cited by examiner

*Primary Examiner*—Carl D. Price
(74) *Attorney, Agent, or Firm*—McAfee & Taft

(57) ABSTRACT

Low $NO_x$ axial premix burner apparatus and methods for burning fuel gas are provided by the present invention. The methods of the invention are basically comprised of the steps of mixing a first portion of the fuel gas and all of the air to form a lean primary fuel gas-air mixture, discharging the lean primary fuel gas-air mixture into the furnace space whereby the mixture is burned in a primary combustion zone therein, discharging a second portion of the fuel gas into the primary combustion zone to stabilize the flame produced therein and discharging the remaining portion of the fuel gas into a secondary combustion zone in the furnace space.

8 Claims, 2 Drawing Sheets

LOW $NO_x$ PREMIX BURNER APPARATUS AND METHODS

BACKGROUND OF THE INVENTION

1. Field of the Invention

The present invention relates to low $NO_x$ producing burner apparatus and methods, and more particularly, to low $NO_x$ axial premix burner apparatus and methods.

2. Description of the Prior Art

Because of stringent environmental emission standards adopted by government authorities and agencies, burner apparatus and methods have heretofore been developed which suppress the formation of nitrogen oxides ($NO_x$) in flue gases produced by the combustion of fuel-air mixtures. For example, burner apparatus and methods wherein liquid or gaseous fuel is burned in less than a stoichiometric concentration of air to lower the flame temperature and thereby reduce thermal $NO_x$ have been developed. That is, staged air burner apparatus and methods have been developed wherein the fuel is burned in a deficiency of air in a first combustion zone whereby a reducing environment which suppresses $NO_x$ formation is produced, and the remaining portion of the air is introduced into a second zone downstream from the first zone wherein the unburned remaining fuel is combusted.

Staged fuel burner apparatus have also been developed wherein all of the air and some of the fuel is burned in a first zone with the remaining fuel being burned in a second downstream zone. In such staged fuel burner apparatus and methods, an excess of air in the first zone functions as a diluent which lowers the temperature of the burning gases and thereby reduces the formation of $NO_x$.

While staged fuel burners which produce flue gases containing low levels of $NO_x$ have been utilized heretofore, there are continuing needs for improved axial premix burner apparatus having high firing capacities and producing flue gases having ultra low $NO_x$ emission levels and methods of using the apparatus.

SUMMARY OF THE INVENTION

By the present invention low $NO_x$ axial premix burner apparatus and methods are provided which meet the needs described above and overcome the deficiencies of the prior art. That is, in accordance with the present invention, a low $NO_x$ forming premix burner apparatus for burning gaseous fuels adapted to be connected to a furnace space is provided. The burner apparatus includes a housing having a discharge end attached to the furnace space and a closed opposite end. Means for introducing air into the housing are attached thereto and a burner tile having an opening therethrough and optionally including a flame stabilizing block as a part thereof is disposed within the furnace space adjacent to the burner housing. At least one elongated primary fuel gas and air venturi mixer is disposed within the housing having an open inlet end positioned adjacent to the closed end of the housing and a primary fuel gas-air mixture discharge nozzle attached to the other end thereof. The discharge nozzle extends into the burner tile through the opening therein and is positioned so that the flame produced by the burning of the primary fuel gas-air mixture is projected in a direction which is axial to the burner housing and impinges on the flame stabilizing block when it is utilized. A first primary fuel gas nozzle connected to a source of pressurized fuel gas is positioned to discharge a primary gas fuel jet into the open inlet end of the elongated venturi mixer whereby air from within the housing is drawn into the mixer, the air is mixed with the primary fuel gas therein and the resulting primary fuel gas-air mixture is discharged by the discharge nozzle and burned in the burner tile and in the furnace space. A second primary fuel gas nozzle connected to a source of pressurized fuel gas is positioned within the burner tile to discharge additional primary fuel gas into the flame therein whereby the flame is further stabilized. At least one secondary fuel gas nozzle connected to a source of pressurized fuel and positioned to discharge secondary fuel gas within the furnace space is provided whereby the secondary fuel gas mixes with air and flue gases in the furnace space and is burned therein.

The methods of the present invention basically comprise the following steps. (a) mixing a first portion of the fuel gas and all of the air to form a lean primary fuel gas-air mixture; (b) discharging the lean primary fuel gas-air mixture into a furnace space whereby the mixture is burned in a primary combustion zone therein and flue gases having very low $NO_x$ content are formed therefrom; (c) discharging a second portion of the fuel gas into the primary combustion zone whereby the second portion of the fuel gas is mixed with air and is burned to further stabilize the flame produced therein; and (d) discharging the remaining portion of the fuel gas into a secondary combustion zone in the furnace space wherein the remaining portion of the fuel gas mixes with air in the furnace space and with flue gases therein to form a second fuel gas-air mixture diluted with flue gases whereby the mixture is burned in the secondary combustion zone and additional flue gases having very low $NO_x$ content are formed therefrom. The flame produced in the primary combustion zone by the burning of the lean primary fuel gas-air mixture discharged in accordance with step (a) can optionally contact a flame stabilizing block in the furnace space.

It is, therefore, a general object of the present invention to provide an improved low $NO_x$ axial premix burner apparatus and methods of burning an at least substantially stoichiometric mixture of fuel gas and air whereby flue gases having very low $NO_x$ content are formed therefrom.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

The present invention provides a low $NO_x$ axial premix burner which provides a high heat release and a high burner efficiency while maintaining very low $NO_x$ formation. The burner apparatus can achieve very high firing capacity, a variety of flame shapes, excellent stability and very low $NO_x$ emissions which meet desired performance specifications. The burner apparatus may be utilized to fire horizontally along a furnace floor, vertically up a furnace wall or at an angle along a furnace wall. Other advantages of the burner apparatus and methods of this invention will be apparent to those skilled in the art from the following description.

Figure 1:
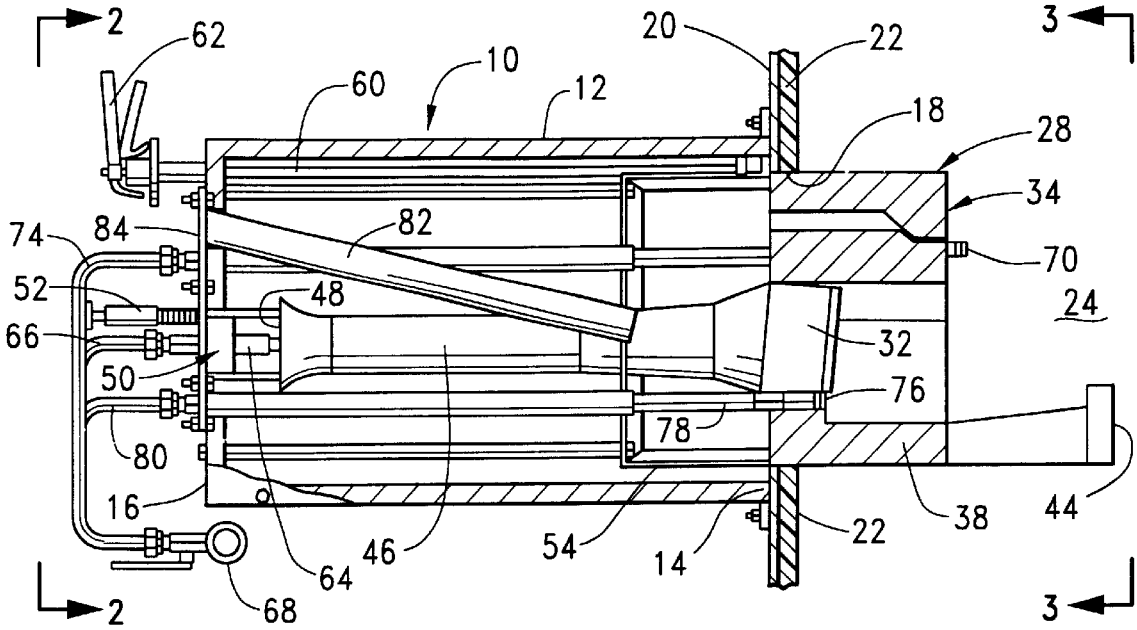
FIG. 1 is a side elevational view of the burner apparatus of the present invention attached to a furnace space.

Referring now to the drawings, the low $NO_x$ premix axial burner apparatus of the present invention is illustrated and generally designated by the numeral 10. The burner 10 includes a housing 12 having an open discharge end 14 and a closed opposite end 16. As illustrated in FIG. 1, the open end 14 of the housing 12 is adapted to be connected to an opening 18 in a wall 20 of a furnace. As will be understood by those skilled in the art, the furnace wall 18 generally includes an internal layer of insulation material 22 and the wall 20 and insulation material 22 define a furnace space 24 within which fuel and air are burned to form hot flue gases.

Figure 2:
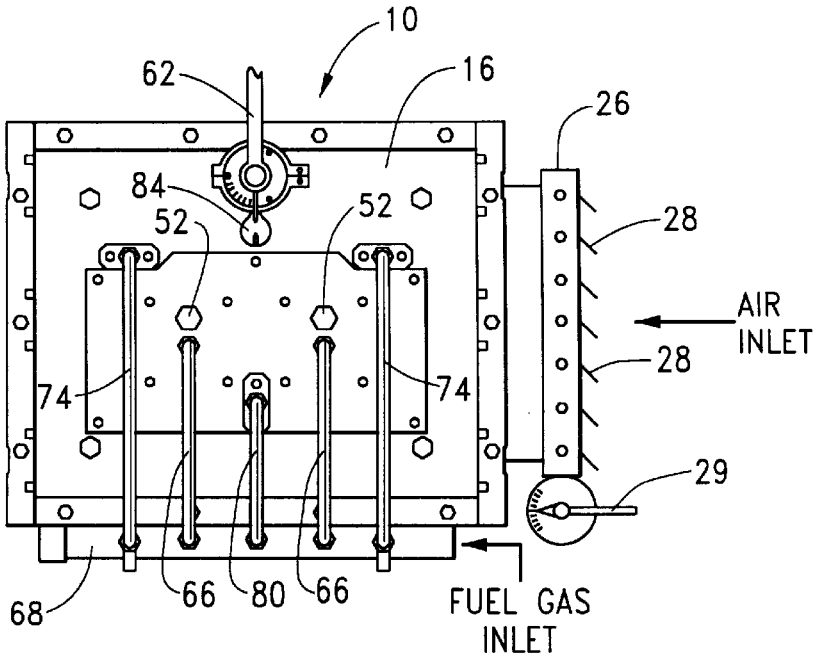
FIG. 2 is an end view of the burner apparatus taken along line 2—2 of FIG. 1.

As shown in FIG. 2, an air register 26 is sealingly connected over an opening (not shown) in a side of the housing 12 for introducing a controlled quantity of air into the housing 12. The air register 26 includes louvers 28 or the like which can be adjusted by means of a handle 29 to control the quantity of air flowing therethrough and into the housing 12.

Figure 3:
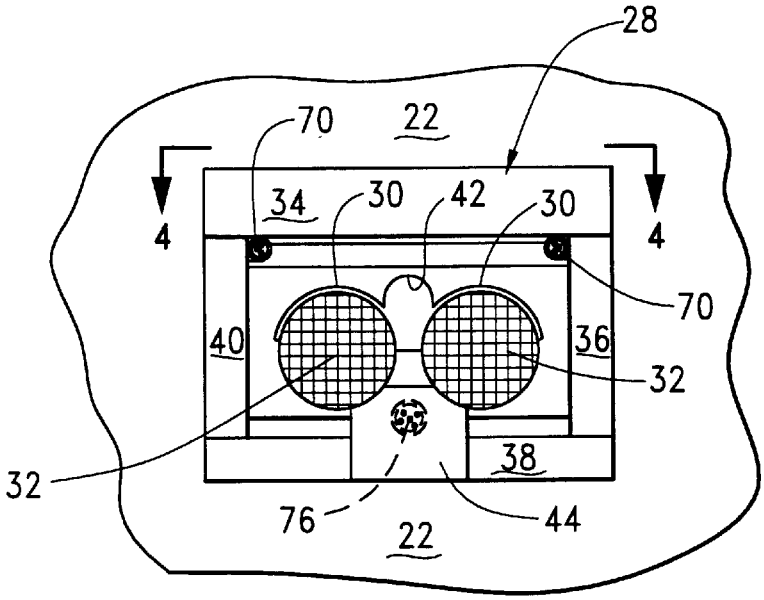
FIG. 3 is an opposite end view of the burner apparatus taken along line 3—3 of FIG. 1.
Figure 4:
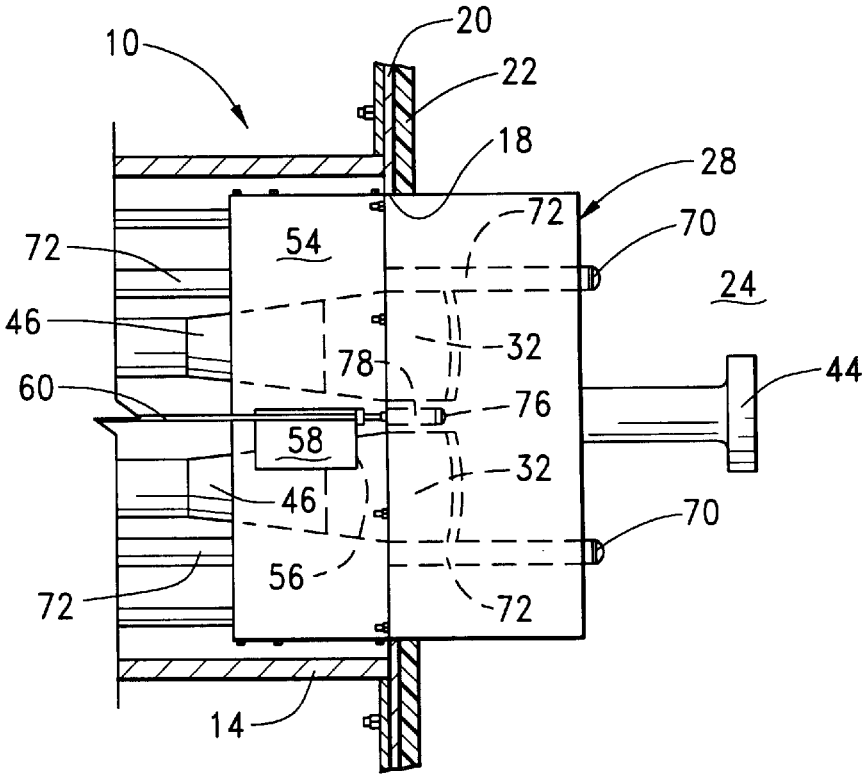
FIG. 4 is a cross-sectional view of the burner apparatus taken along line 4—4 of FIG. 3.

A burner tile generally designated by the numeral 28 is attached to the open inlet end 14 of the housing 12 and extends into the furnace space 24 as shown in FIGS. 1 and 4. In an alternate arrangement, the burner tile 28 can be disposed in the furnace space 24 sealingly attached over the opening 18 in the wall 20 of the furnace space 24. The burner tile 28 is formed of a heat and flame resistant ceramic material and can be molded as a single part or it can be formed of a plurality of parts as shown in FIGS. 1 and 3. The burner tile 28 includes two openings 30 (FIG. 3) for receiving discharge nozzles 32 connected to a pair of fuel gas and air venturi mixers which will be described further hereinbelow. The openings 30 and the discharge nozzles 32 are surrounded by the side and bottom walls 34, 36, 38 and 40 of the burner tile 28. The center portion of the burner tile 28 surrounding the discharge nozzles 32 includes an opening 42 therein. Also, a flame stabilizing block 44 can optionally be attached to or otherwise positioned adjacent to the bottom wall 38 of the burner tile 28.

As shown in FIGS. 1, 3 and 4, a pair of fuel gas and air venturi mixers 46 are axially disposed within the housing 12. The elongated venturi mixers 46 each include an open end 48 positioned adjacent to the closed end 16 of the housing 12 with the other end being connected to a previously mentioned discharge nozzle 32. The discharge nozzles 32 are positioned at slight angles such that the fuel gas and air mixtures discharged through the nozzles 32 and the flame produced from their combustion is projected towards the flame stabilizing block 44 when it is utilized. Each of the venturi mixers 46 includes an adjustable air door assembly at the open inlet end thereof generally designated by the numeral 50 (FIG. 1). Control handles 52 which are a part of the assemblies 50 are utilized to control and balance the air entering the venturi mixers 46.

As best shown in FIGS. 1 and 4, a closed compartment generally designated by the numeral 54 is disposed within the housing 20 and sealingly attached over the opening 18 in the furnace space 24. The closed compartment 54 includes an opening 56 therein (FIG. 4) and a door 58 is hinged to the compartment 54 over the opening 56. The door 58 is connected to a rod 60 which is in turn connected to a control handle mounted on the outside of the closed end of the housing 12 for opening and closing the door 58. When the door 58 is opened, air from within the housing 12 flows through the opening 56 into the closed compartment 54 and then flows into the furnace space 24 by way of the opening 42 in the burner tile 28. While the door 58 can be used to allow a controlled rate of secondary air into the furnace space 24, it is normally only used when the fuel gas-air mixtures discharged from the venturi mixers 46 are initially ignited as will be described hereinbelow.

A pair of primary fuel gas nozzles 64 are attached to the closed end 16 of the housing 12 and are positioned to discharge primary fuel gas jets into the open ends 48 of the venturi mixers 46 (only one of the nozzles 64 and one venturi mixer 46 are shown in FIG. 1). Each of the primary fuel gas nozzles 64 is connected by a conduit 66 to a fuel gas header 68 as shown in FIGS. 1 and 2. As will be understood by those skilled in the art, the primary fuel gas jets discharged into the open ends 48 of the venturi mixers 46 cause air from within the housing 12 to be drawn into the venturi mixers 46 whereby the air mixes with the discharged primary fuel gas and the resulting mixtures exit the venturi mixers 46 by way of the discharge nozzles 32 attached thereto. The discharge nozzles 32 include a plurality of openings therein designed to provide the total exit area necessary for the fuel gas-air mixtures from the venturi mixers to flow through the discharge nozzles. Also, as is well understood by those skilled in the art, the discharge nozzles 32 are of a design to insure that the burner 10 can be operated without the occurrence of flash backs.

A pair of secondary fuel gas nozzles (staged fuel gas nozzles) 70 are positioned at the end of the burner tile 28 within the furnace space 24. The secondary fuel gas tips 70 are positioned above and on opposite sides of the two fuel gas-air mixture discharge nozzles 32, and the nozzles 70 are oriented so that the secondary fuel gas is discharged into a secondary combustion zone downstream of the primary combustion zone within the furnace space 24.

The flame produced by the burning of the primary fuel gas-air mixtures discharged from the nozzles 32 impinges on the flame stabilizing block 44 when it is utilized causing the block to be heated, stabilizing the flame and establishing a mixing zone within the primary combustion zone in the furnace space 24. Because the primary fuel gas-air mixtures discharged into the primary combustion zone contain excess air, the flue gases generated in the primary combustion zone have a very low $NO_x$ content. The secondary fuel gas discharged by the secondary fuel gas nozzles 70 into the secondary combustion zone mixes with air remaining in the furnace space and with flue gases contained therein to form a second fuel gas-air mixture diluted with flue gases which is burned in the secondary combustion zone forming additional flue gases having very low $NO_x$ content. The secondary fuel gas nozzles 70 are connected by conduits 72 within the housing 12 and by conduits 74 outside the closed end 16 of the housing 12 to the fuel gas inlet header 68.

In order to further stabilize the flame produced in the primary combustion zone in addition to the flame stabilization brought about by the stabilizing block 44 when it is used, a primary fuel gas nozzle 76 is positioned adjacent to the primary fuel gas-air discharge nozzles 32. That is, the primary fuel gas nozzle 76 is positioned below and between the discharge nozzles 32 as best shown in FIG. 3. The primary fuel gas nozzle 76 is connected by a conduit 78 within the housing 12 and a conduit 80 outside the housing 12 to the fuel gas inlet header 68. The primary fuel gas discharged into the primary combustion zone by the fuel gas nozzle 76 mixes with air in the primary combustion zone and forms a fuel gas-air mixture therein which is substantially stoichiometric. The burning of that mixture in the primary combustion zone functions to stabilize the overall flame produced.

A conduit 82 for facilitating the ignition of the primary fuel gas-air mixtures discharged by the venturi mixer discharge nozzles 32 is sealingly connected through the closed end 16 of the housing 12 and through and into the closed compartment 54. A cover door is attached to the housing 12 over the outside end of the conduit 82. As will be understood by those skilled in the art, a torch is inserted through the conduit 82 into the closed compartment 54 and through the opening 42 for igniting the primary fuel gas-air mixture exiting the nozzles 32. Prior to inserting the torch, the air door 58 in the closed compartment 54 is opened to insure that fuel gas does not enter the closed compartment 54 prior to ignition.

As will be understood by those skilled in the art, depending on the design conditions to be met by the burner apparatus 10, the burner apparatus can include one or more primary fuel gas-air venturi mixers, one or more first primary fuel gas nozzles for injecting primary fuel gas into the venturi mixer or mixers, one or more second primary fuel gas nozzles for stabilizing the flame in the primary combustion zone and one or more secondary fuel gas nozzles for introducing fuel gas into the secondary combustion zone. Further, a single primary fuel gas-air venturi mixer having a plurality of primary fuel nozzles therein for causing air to be drawn into the venturi mixer can be used.

The methods carried out by the burner apparatus of this invention, i.e., the methods of discharging an at least substantially stoichiometric mixture of fuel gas and air into a furnace space wherein the mixture is burned and flue gases having very low $NO_x$ content are formed therefrom, are basically comprised of the following steps: (a) a first portion of the fuel gas (referred to herein as primary fuel gas) and all of the air are mixed in the venturi mixers 46 to form lean primary fuel gas-air mixtures; (b) the lean primary fuel gas-air mixtures are discharged into the furnace space 24 whereby the mixtures are burned in a primary combustion zone therein, the flame produced optionally contacts a flame stabilizing block 44 in the furnace space 24 and is stabilized thereby and flue gases having very low $NO_x$ content are formed therefrom; (c) a second portion of the fuel gas (also referred to as primary fuel gas) is discharged into the primary combustion zone whereby the second portion of the primary fuel gas is mixed with air and is burned to stabilize the flame produced in the primary combustion zone; and (d) the remaining portion of the fuel gas (referred to as secondary fuel gas) is discharged into a secondary combustion zone in the furnace space 24 wherein the remaining portion of the fuel gas mixes with air remaining in the furnace space 24 and with flue gases contained therein to form a second fuel gas-air mixture diluted with flue gases whereby the mixture is burned in the secondary combustion zone and additional flue gases having very low $NO_x$ content are formed therefrom.

As mentioned above, depending upon the particular application involved, the above described method can be carried out in a burner apparatus of this invention having one or more primary fuel gas-air venturi mixers, one or more first primary fuel gas nozzles for injecting primary fuel gas into the venturi mixer or mixers, one or more second primary fuel gas nozzles for stabilizing the flame in the primary combustion zone and one or more secondary fuel gas nozzles for introducing fuel gas into the secondary combustion zone.

The lean mixture of the first portion of the primary fuel gas and air which is discharged into the primary combustion zone is generally a mixture having a stoichiometric ratio of fuel gas to air of about 1.5:4. The first portion of the primary fuel gas in the lean primary fuel gas-air mixture is also generally an amount in the range of from about 30% to about 70% by volume of the total fuel gas discharged into the furnace space. The second portion of the primary fuel gas discharged into the primary combustion zone to stabilize the flame is generally an amount in the range of from about 2% to about 25% by volume of the total fuel gas discharged into the furnace space. The remaining portion of the fuel gas, i.e., the secondary fuel gas, is generally discharged into the secondary combustion zone in an amount in the range of from about 25% to about 68% by volume of the total fuel gas discharged into the furnace space.

In order to further illustrate the burner apparatus and methods of the present invention, the following example is given.

EXAMPLE

A burner apparatus 10 designed for a heat release of 4.8 BTU per hour by burning fuel gas having a caloric value of 1160 BTU per SCF is fired into the furnace space 24. Pressurized fuel gas is supplied to the burner 10 at a pressure of about 45 psig and at a rate of 4100 SCF per hour. A portion of the fuel gas flows into and through the primary fuel gas and air venturi mixers 46 wherein the fuel gas is mixed with air. The lean primary fuel gas-air mixtures formed in the venturi mixers 46 are discharged into a primary combustion zone in the furnace space wherein they are burned and the flame produced contacts the flame stabilizing block 44 and is stabilized thereby. A second portion of the fuel gas is discharged into the furnace space 24 by way of the primary fuel gas nozzle 76 wherein it is mixed with air and is burned to further stabilize the flame produced in the primary combustion zone. The remaining portion of the fuel gas is discharged into the furnace space by way of the secondary fuel gas nozzles 70. In this example, the rate of air introduced in the housing 12 is controlled by means of the damper 28 such that the total rate of air introduced into the furnace space 24 is an amount which results in 15% excess air therein. All of the air is introduced into the furnace space 24 by way of the venturi mixers 46.

The secondary fuel gas discharged from the secondary fuel nozzles 70 mixes with the air remaining in the furnace space 24 and relatively cool flue gases therein to form a flue gases diluted fuel-air mixture which is burned in a secondary combustion zone adjacent to the primary combustion zone in the furnace space 24.

As a result of the burning of the lean primary fuel gas-air mixture in the primary combustion zone and the flue gases diluted secondary fuel gas-air mixture in the secondary combustion zone, the flue gases exiting the furnace space 24 have a very low $NO_x$ content. That is, the flue gases withdrawn from the furnace space 24 have a $NO_x$ content of less than about 12 ppm.

Thus, the present invention is well adapted to carry out the objects and the ends and advantages mentioned as well as those which are inherent therein. While presently preferred embodiments of the invention have been described for purposes of this disclosure, numerous changes in the construction and in the arrangement of parts and steps will suggest themselves to those skilled in the art which are encompassed within the spirit of this invention as defined by the appended claims.

What is claimed is:

1. A method of discharging an at least substantially stoichiometric mixture of fuel gas and air into a furnace space wherein said mixture is burned and flue gases having low $NO_x$ content are formed therefrom comprising the steps of:

(a) mixing a first portion of said fuel gas and all of said air to form a lean primary fuel gas-air mixture;

(b) discharging said lean primary fuel gas-air mixture into said furnace space whereby said mixture is burned in a primary combustion zone therein and flue gases having low $NO_x$ content are formed therefrom, whereby said furnace space substantially encompasses said primary combustion zone;

(c) providing a flame stabilizing block in said furnace space positioned so that the flame produced by the burning of said lean primary fuel gas-air mixture therein impinges on said flame stabilizing block and is stabilized thereby:

(d) discharging a second portion of said fuel gas into said primary combustion zone whereby said second portion of said fuel gas is mixed with a portion of said air and is burned to stabilize said flame produced therein; and (e) discharging the remaining portion of said fuel gas into a secondary combustion zone in said furnace space, whereby said furnace space encompasses said secondary combustion zone, wherein said remaining portion of said fuel gas mixes with air remaining in said furnace space and with flue gases contained therein to form a second fuel gas-air mixture diluted with flue gases whereby said mixture is burned in said secondary combustion zone and additional flue gases having low $NO_x$ content are formed therefrom.

2. The method of claim 1 wherein said lean primary fuel gas-air mixture is formed in a primary fuel gas and air venturi mixer and discharged into said primary combustion zone through a discharge nozzle attached thereto.

3. The method of claim 1 wherein said lean primary fuel gas-air mixture is formed in two or more primary fuel gas and air venturi mixers and discharged into said primary combustion zone through discharge nozzles attached thereto.

4. The method of claim 1 wherein said remaining portion of said fuel gas is discharged into said secondary combustion zone by at least one secondary fuel gas nozzle.

5. The method of claim 1 wherein said lean primary fuel gas-air mixture discharged into said furnace space has a stoichiometric ratio of fuel gas to air of about 1.5:4.

6. The method of claim 1 wherein said first portion of said fuel gas in said lean primary fuel gas-air mixture discharged into said furnace space is an amount in the range of from about 30% to about 70% by volume of the total fuel gas discharged into said furnace space.

7. The method of claim 1 wherein said second portion of said fuel gas discharged into said furnace space is an amount in the range of from about 2% to about 25% by volume of the total fuel gas discharged into said furnace space.

8. The method of claim 1 wherein said remaining portion of said fuel gas discharged into said furnace space is an amount in the range of from about 25% to about 68% by volume of the total fuel gas discharged into said furnace space.

* * * * *